US011808527B2

(12) United States Patent
Welch et al.

(10) Patent No.: US 11,808,527 B2
(45) Date of Patent: Nov. 7, 2023

(54) PLASTIC FILM HEAT EXCHANGER FOR LOW PRESSURE AND CORROSIVE FLUIDS

(71) Applicant: Emerson Climate Technologies, Inc., Sidney, OH (US)

(72) Inventors: Andrew M. Welch, Franklin, OH (US); Daniel J. Rice, Sidney, OH (US)

(73) Assignee: Copeland LP, Sidney, OH (US)

( * ) Notice: Subject to any disclaimer, the term of this patent is extended or adjusted under 35 U.S.C. 154(b) by 57 days.

(21) Appl. No.: 17/193,293

(22) Filed: Mar. 5, 2021

(65) Prior Publication Data

US 2022/0282930 A1 Sep. 8, 2022

(51) Int. Cl.

| | |
|---|---|
| ***F28D 9/00*** | (2006.01) |
| ***F28F 3/08*** | (2006.01) |
| ***F28F 3/04*** | (2006.01) |

(52) U.S. Cl.

CPC ..... *F28D 9/005* (2013.01); *F28F 3/083* (2013.01); *F28F 3/046* (2013.01); *F28F 3/048* (2013.01); *F28F 2250/104* (2013.01)

(58) Field of Classification Search

CPC ..... F28F 9/005; F28F 9/0043; F28F 9/0037; F28F 3/042; F28F 3/048

See application file for complete search history.

(56) References Cited

U.S. PATENT DOCUMENTS

| | | | | |
|---|---|---|---|---|
| 3,823,457 A | | 7/1974 | Staas et al. | |
| 4,523,638 A | * | 6/1985 | Rosman | F28D 9/0018 165/167 |
| 4,744,414 A | | 5/1988 | Schon | |
| 4,815,534 A | * | 3/1989 | Fuerschbach | F28F 13/12 165/166 |
| 5,383,518 A | * | 1/1995 | Banks | F28D 9/005 165/170 |
| 5,544,703 A | * | 8/1996 | Joel | F28F 21/02 165/166 |
| 6,170,568 B1 | * | 1/2001 | Valenzuela | F28F 3/044 165/DIG. 357 |
| 6,192,596 B1 | * | 2/2001 | Bennett | F28D 9/005 422/615 |
| 6,684,943 B2 | | 2/2004 | Dobbs et al. | |
| 7,040,387 B2 | * | 5/2006 | Leuthner | F28D 9/005 165/906 |

(Continued)

FOREIGN PATENT DOCUMENTS

| | | | | |
|---|---|---|---|---|
| CN | 103424024 A | | 12/2013 | |
| DE | 202008008437 U1 | * | 11/2008 | F28D 9/005 |

(Continued)

OTHER PUBLICATIONS

Written Opinion of the ISA regarding International Application No. PCT/US2022/018756 dated Jun. 23, 2022.

(Continued)

*Primary Examiner* — Jianying C Atkisson
*Assistant Examiner* — For K Ling
(74) *Attorney, Agent, or Firm* — Harness, Dickey & Pierce, P.L.C.

(57) ABSTRACT

A heat exchanger including a pair of end plates, a plurality of flow plates sandwiched between the pair of end plates, and a plurality of heat transfer films that are respectively positioned between adjacent flow plates, and between each of the end plates and an immediately adjacent flow plate.

18 Claims, 13 Drawing Sheets

(56) References Cited

U.S. PATENT DOCUMENTS

| | | | | |
|---|---|---|---|---|
| 8,550,151 | B2 | 10/2013 | Murayama et al. | |
| 9,618,278 | B2 | 4/2017 | Denkenberger | |
| 9,835,340 | B2 | 12/2017 | Vandermeulen et al. | |
| 10,012,444 | B2 | 7/2018 | Eplee | |
| 2002/0192531 | A1* | 12/2002 | Zimmerman | H01M 8/2483 429/492 |
| 2009/0065183 | A1* | 3/2009 | Uneno | F28F 1/40 165/173 |
| 2009/0133463 | A1 | 5/2009 | Goldman et al. | |
| 2011/0088882 | A1* | 4/2011 | Persson | F28D 9/005 29/890.039 |
| 2012/0103579 | A1* | 5/2012 | Reif | F28F 17/005 165/167 |
| 2013/0213449 | A1* | 8/2013 | Parish | F28F 3/022 136/224 |
| 2014/0020866 | A1* | 1/2014 | Bluetling | F28F 9/0246 165/104.19 |
| 2014/0260398 | A1 | 9/2014 | Kozubal et al. | |
| 2015/0083381 | A1 | 3/2015 | Furumura | |
| 2016/0356560 | A1* | 12/2016 | Wei | F28F 3/10 |
| 2016/0376709 | A1 | 12/2016 | Galos et al. | |
| 2017/0067691 | A1 | 3/2017 | Wada et al. | |
| 2017/0106639 | A1 | 4/2017 | Vandermeulen et al. | |
| 2019/0107338 | A1 | 4/2019 | Romanin et al. | |
| 2019/0113292 | A1 | 4/2019 | Eastman et al. | |
| 2019/0353358 | A1 | 11/2019 | Allen et al. | |
| 2020/0141593 | A1 | 5/2020 | Vandermeulen et al. | |

FOREIGN PATENT DOCUMENTS

| | | | | |
|---|---|---|---|---|
| FR | 3036179 | A1 * | 11/2016 | F28D 1/0341 |
| WO | WO-1999066279 | A2 | 12/1999 | |
| WO | WO-0242704 | A1 * | 5/2002 | B01J 19/249 |

OTHER PUBLICATIONS

ISR regarding International Application No. PCT/US2022/018756 dated Jun. 23, 2022.

* cited by examiner

PLASTIC FILM HEAT EXCHANGER FOR LOW PRESSURE AND CORROSIVE FLUIDS

FIELD

The present disclosure relates to a heat exchanger configured for use with low pressure and corrosive fluids.

BACKGROUND

This section provides background information related to the present disclosure which is not necessarily prior art.

A heat exchanger is an apparatus for transferring heat from one fluid to another, which may be incorporated in a number of different systems. For example, various systems that may utilize a heat exchanger include heating systems, refrigeration systems, HVAC systems, power stations, chemical plants, petrochemical plants, petroleum refineries, natural-gas processing systems, desalination systems, and sewage treatment systems to name a few. Although a heat exchanger may be included in these example systems, the design of the heat exchanger for each of these systems may vary in size, construction, and material.

More particularly, in a HVAC system for example, the structure of the heat exchanger and the heat transfer surface may be metal to withstand the pressure requirements of the refrigerant contained in the HVAC system. The use of metal materials, however, limits the type of refrigerants that may be used in the HVAC system. In this regard, if the refrigerant is corrosive to the metal material, the refrigerant can reduce the useful life of the heat exchanger. Thus, it is desirable to have a heat exchanger that is resistant to reactions with corrosive fluids that are undergoing heat exchange.

SUMMARY

This section provides a general summary of the disclosure and is not a comprehensive disclosure of its full scope or all of its features.

According to a first aspect, the present disclosure provides a heat exchanger that may include a pair of end plates, where each of the end plates include a first major surface and an opposite second major surface. The first major surfaces each include fluid inlet and a fluid outlet and the opposite second major surfaces each include a flow trough. The fluid inlet of each end plate is in communication with the flow trough formed on the opposite second major surface of the respective end plate. A plurality of flow plates are sandwiched between the pair of end plates, where each of the flow plates have a first side and an opposite second side, and each of the first side and the opposite second side include a flow surface. The flow surfaces of each flow plate are configured to communicate with either the flow trough of an adjacent end plate or one of the flow surfaces of an adjacent flow plate. A plurality of heat transfer films are respectively positioned between adjacent flow plates, and between each of the end plates and an immediately adjacent flow plate, wherein the flow troughs and the flow surfaces each include a first flow channel and a second flow channel separated by a dividing wall, and a plurality of support features. The dividing wall and the plurality of support features each support the heat transfer film in a manner that a minimum area of the heat transfer film is unsupported. The first and second flow channels may each include a turbulence inducing surface that is configured to increase a turbulence of a fluid flowing in the flow troughs and flow surfaces.

According to the first aspect, the flow troughs and flow surfaces communicate with each other such that a fluid that enters the fluid inlet of one of the end plates will exit the fluid outlet of the other end plate, and a fluid that enters the fluid inlet of the other end plate will exit the fluid outlet of the one end plate.

According to the first aspect, the fluid that enters the fluid inlet of the one end plate will enter the flow trough on the opposite second major surface of the one end plate and flow in a first direction before entering the flow surface the adjacent flow plate and flowing in a second and opposite direction.

According to the first aspect, the pair of end plates and each of the flow plates may be formed of a polymeric material that is impermeable and resistant to corrosion.

According to the first aspect, the heat transfer films may each formed of a polymer film, and the heat transfer films include one of a removable adhesive layer, an integral gasket, and a resilient sealant to sealingly engage with the end plates and the flow plates. The heat transfer films may be sealingly engaged with the end plates and the flow plates by being interference fit thereto, or the heat transfer films may be joined to the end plates and flow plates through application of heat.

According to the first aspect, the plurality of support features may include a plurality of nubs that are spaced part to permit fluid flow therebetween.

According to the first aspect, the first major surface of each of the end plates may include a plurality of ribs that increase the rigidity of the end plates.

According to the first aspect, the turbulence inducing surfaces of the end plates and the flow plates may each include a plurality of elongated bumps that extend across the first and second flow channels, respectively.

According to the first aspect, each of the flow plates includes a fluid inlet port and a fluid outlet port, wherein the fluid inlet port of a respective flow plate communicates with either the flow trough of the adjacent end plate or the fluid outlet port of the adjacent flow plate.

Lastly, according to the first aspect, the flow troughs and flow surfaces may be scroll-shaped.

According to a second aspect of the present disclosure, there is provided a heat exchanger that includes a first end plate and a second end plate. Each of the end plates includes a first major surface and an opposite second major surface. The first major surface of the first end plate includes a pair of fluid inlets and the opposite second major surface including a first flow trough. The first major surface of the second end plate includes a pair of fluid outlets and the opposite second major surface includes a second flow trough. One of the fluid inlets of the first end plate is in communication with the first flow trough formed on the opposite second major surface of the first end plate and one of the fluid outlets of the second end plate is in communication with the second flow trough formed on the opposite second major surface of the second end plate. A plurality of flow plates are sandwiched between the first and second end plates. Each of the flow plates have a first side and an opposite second side, and each of the first side and the opposite second side includes a flow surface. The flow surfaces of each flow plate are configured to communicate with the first flow trough of the first end plate, the second flow trough of the second end plate, or one of the flow surfaces of an adjacent flow plate. A plurality of heat transfer films are respectively positioned between adjacent flow plates, and between each of the first and second end plates and an immediately adjacent flow plate. The fluid inlets of the first end plate are configured for receipt of a first fluid and a second fluid, respectively, such that the first and second fluids travel through the heat exchanger in parallel, and such that the first and second fluids exchange heat with each other via the heat transfer films.

According to the second aspect, the first flow trough, the second flow trough, and the flow surfaces may each include a first flow channel and a second flow channel that are separated by a dividing wall and include a turbulence inducing surface that is configured to increase a turbulence of the first and second fluids flowing in the first and second flow channels. The first end plate, the second end plate, and each of the flow plates may include a plurality of support features, and the dividing wall and the plurality of support features may each support the heat transfer film in a manner that a minimum area of the heat transfer film is unsupported.

According to the second aspect, the plurality of support features may include a plurality of nubs that are spaced part to permit fluid flow therebetween.

According to the second aspect, the turbulence inducing surfaces of the first and second end plates and the plurality of flow plates may each include a plurality of elongated bumps that extend across the first and second flow channels, respectively.

According to the second aspect, the first fluid that enters one of the fluid inlets of the first end plate will enter the first flow trough on the opposite second major surface of the first end plate and flow in a first direction before entering the one of the flow surfaces of the adjacent flow plate and flow in a second and opposite direction.

According to the second aspect, the first and second end plates and each of the flow plates may each be formed of a polymeric material that is impermeable and resistant to corrosion.

According to the second aspect, the heat transfer films may each be formed of a polymer film, and the heat transfer films may include one of a removable adhesive layer, an integral gasket, and a resilient sealant to sealingly engage with the end plates and the flow plates. The heat transfer films may be sealingly engaged with the end plates and the flow plates by being interference fit thereto, or the heat transfer films may be joined to the end plates and flow plates through application of heat.

According to the second aspect, the first major surface of each of the first and second end plates may include a plurality of ribs that increase the rigidity of the first and second end plates.

Lastly, according to the second aspect, the first flow trough, the second flow trough, and each of the flow surfaces may be scroll-shaped.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 3:
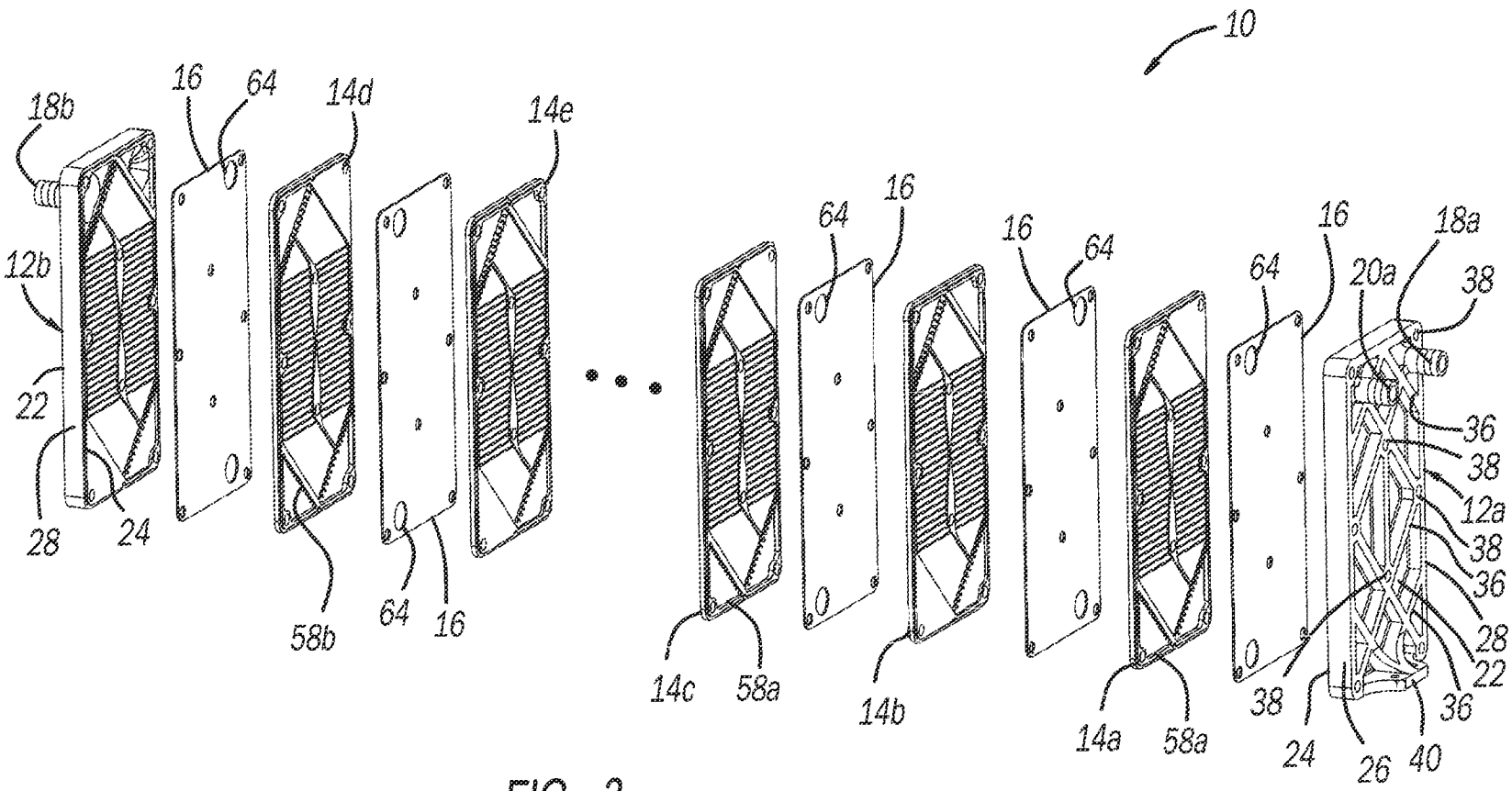
FIG. 3 is an exploded-perspective view of the first example heat exchanger illustrated in FIG. 1.
Figure 4:
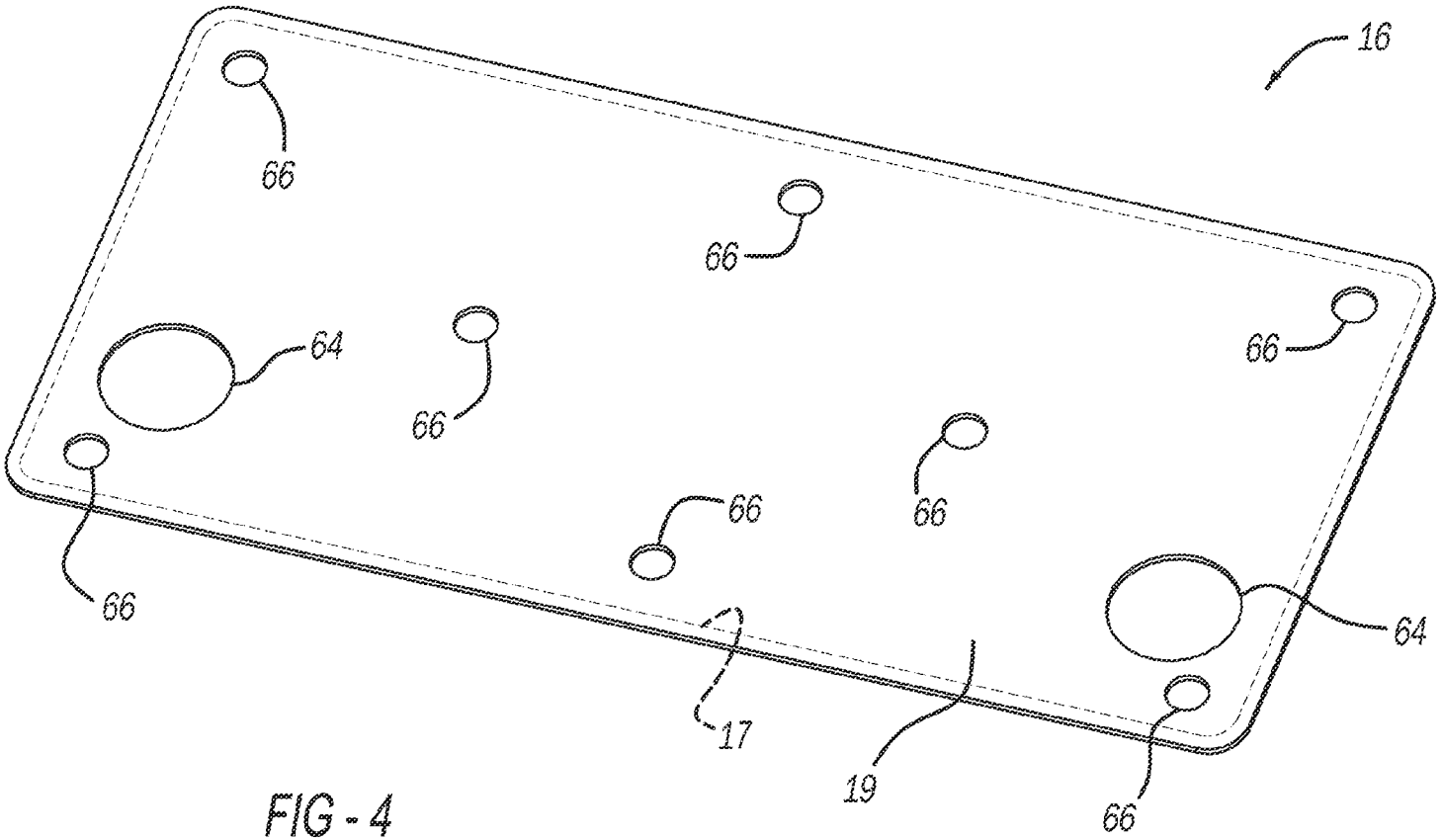
FIG. 4 is a perspective view of a heat transfer film according to a principle of the present disclosure.

Referring to FIGS. 1-6, a first example heat exchanger 10 according to the present disclosure is illustrated. Heat exchanger 10 includes a pair of end plates 12*a* and 12*b*, a plurality of flow plates 14 that are sandwiched by the pair of end plates 12*a* and 12*b*, and a plurality of heat transfer films 16. A heat transfer film 16 is located between each end plate 12*a*, 12*b* and an adjacent flow plate, as well as between adjacent flow plates 14. While five flow plates 14 are illustrated in FIG. 3, it should be understood that this configuration is only an example, and a greater or less number of flow plates 14 can be used in heat exchanger 10 dependent on the application in which heat exchanger 10 is to be used.

End plates 12*a* and 12*b* are preferably formed of a polymeric material that is impermeable and resistant to corrosion. In the illustrated embodiment, end plate 12*a* includes a fluid inlet 18*a* and a fluid outlet 20*a*, and end plate 12*b* includes a fluid inlet 18*b* and a fluid outlet 20*b*. In such a configuration, a fluid entering fluid inlet 18*a* will flow through the heat exchanger 10 and exit at fluid outlet 20*b*, while a fluid entering fluid inlet 18*b* will flow through the heat exchanger 10 and exit fluid outlet 20*a* (i.e., the fluids flow through the heat exchanger 10 in directions counter to each other). It should be understood, however, that the fluid outlet 20*a* of end plate 12*a* may instead function as a second fluid inlet 18*a* such that end plate 12*a* includes a pair of fluid inlets and no fluid outlet, and the fluid inlet 18*b* of end plate 12*b* may instead function as another fluid outlet 20*b* such that end plate 12*b* includes a pair of fluid outlets and no fluid inlet. In such a configuration, the fluids entering the two fluid inlets on end plate 12*a* will flow through the heat exchanger 10 in parallel with one another before each fluid exits the fluid outlets 20*b* formed on the end plate 12*b*. These different configurations will be described in more detail later. Regardless, fluid inlets 18*a*, 18*b* and fluid outlets 20*a*, 20*b* may be unitary with end plates 12*a*, 12*b*, or may be formed separately from end plates 12*a*, 12*b* and attached thereto using an adhesive (not shown), chemical bonding, welding, a threaded connection, or some other type of attachment method known to one skilled in the art.

Figure 5:
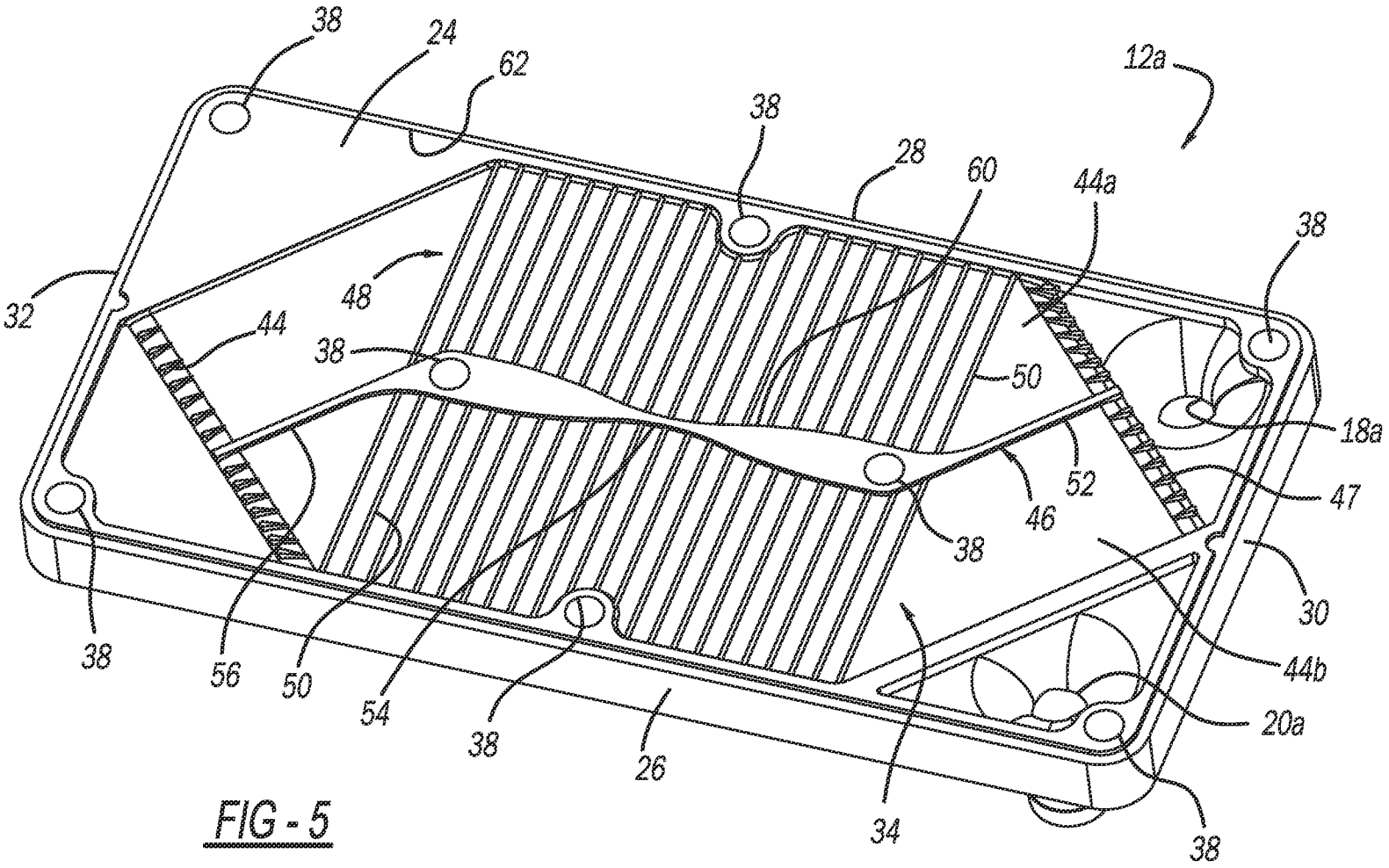
FIG. 5 is a perspective view of a flow-surface side of an end plate used in a first example heat exchanger according to a principle of the present disclosure.
Figure 6:
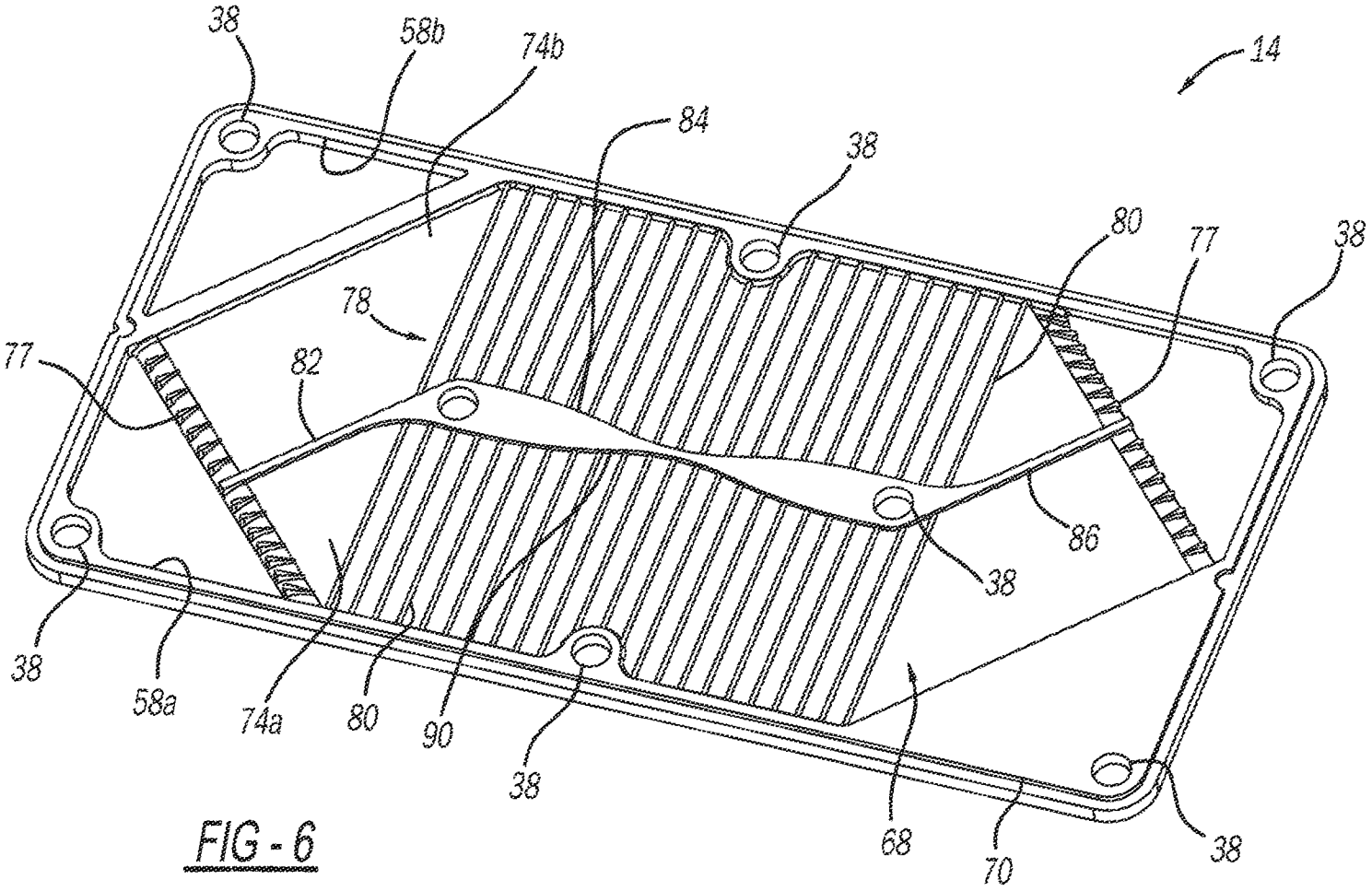
FIG. 6 is a perspective view of a flow plate used in the first example heat exchanger illustrated in FIG. 1.

In the illustrated embodiment, end plates 12*a* and 12*b* are rectangular-shaped planar members including a first major surface 22, an opposite second major surface 24, a first major side surface 26, a second major side surface 28, a third minor side surface 30, and a fourth minor side surface 32. First major surfaces 22 of end plates 12*a* and 12*b* define an exterior of heat exchanger 10 and includes fluid inlets 18*a* and 18*b* and fluid outlets 20*a* and 20*b* extending outward therefrom at a location proximate third minor side surface 30, while second major surface 24 of each of the end plates 12*a* and 12*b* includes a flow trough 34 similar to or the same as the flow surfaces used on flow plates 14 as shown in FIGS. 5 and 6 and as will be described in more detail later. While fluid inlets 18*a* and 18*b* and fluid outlets 20*a* and 20*b* are illustrated as being proximate third minor side surface 30 of each of the end plates 12*a* and 12*b*, it should be understood that fluid inlets 18*a* and 18*b* and fluid outlets 20*a* and 20*b* could be located elsewhere on first major surface 22 without departing from the scope of the present disclosure.

In addition to fluid inlets 18*a* and 18*b* and fluid outlets 20*a* and 20*b*, first major surface 22 of each end plate 12*a* and 12*b* may also include a plurality of ribs 36 that increase the rigidity of end plates 12*a* and 12*b* to withstand fluid pressures and pressure fluctuations that may occur during the heat exchange process. While ribs 36 are illustrated as extending diagonally from a first major side surface 26 of the end plate 12 to second major side surface 28, it should be understood that any configuration for ribs 36 may be used so long as ribs 36 satisfactorily increase the rigidity of end plates 12*a* and 12*b* to withstand fluid pressures and pressure fluctuations that may occur during the heat exchange process.

Figure 1:
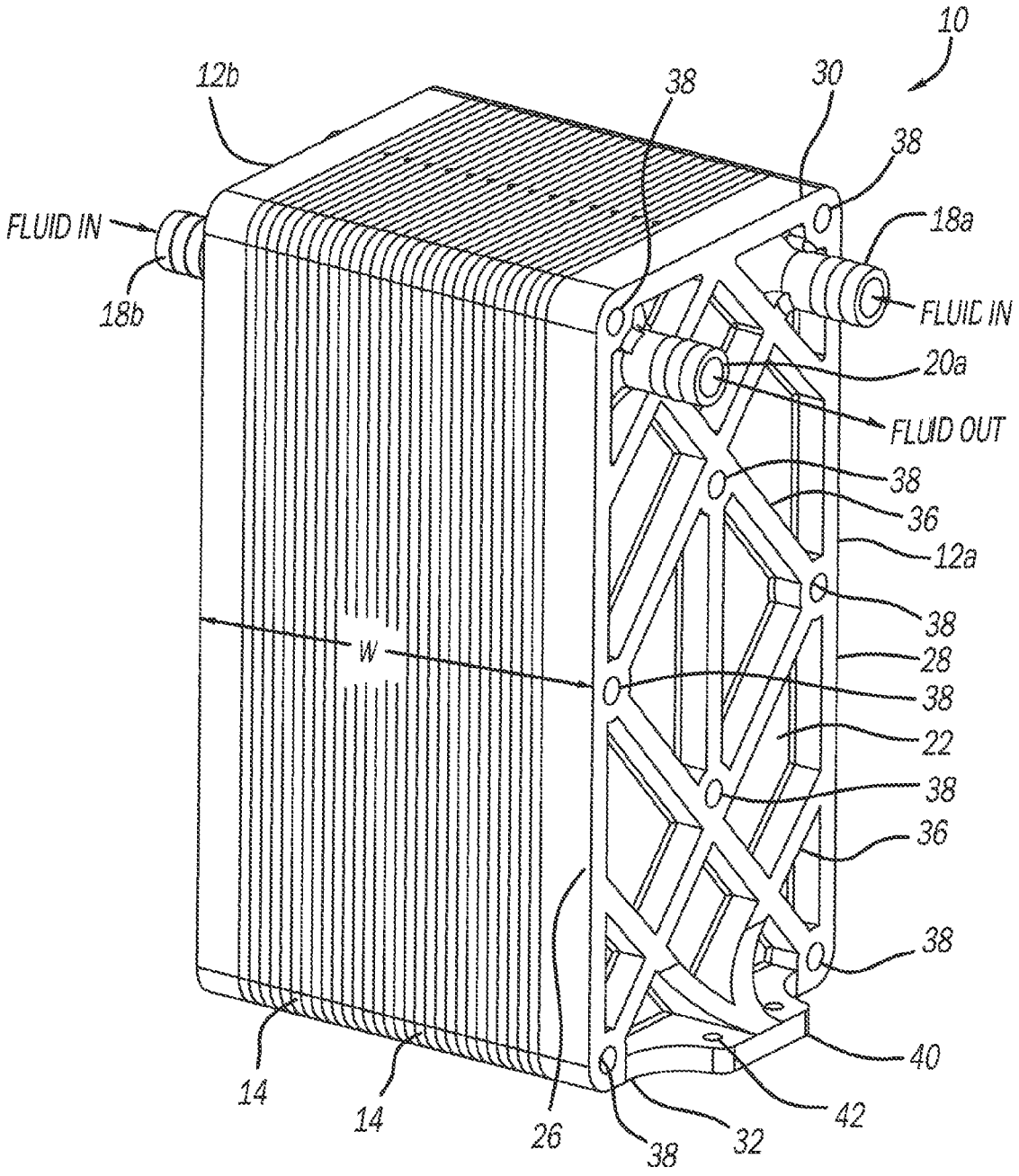
FIG. 1 is a perspective view of a first example heat exchanger according to a principle of the present disclosure.
Figure 2:
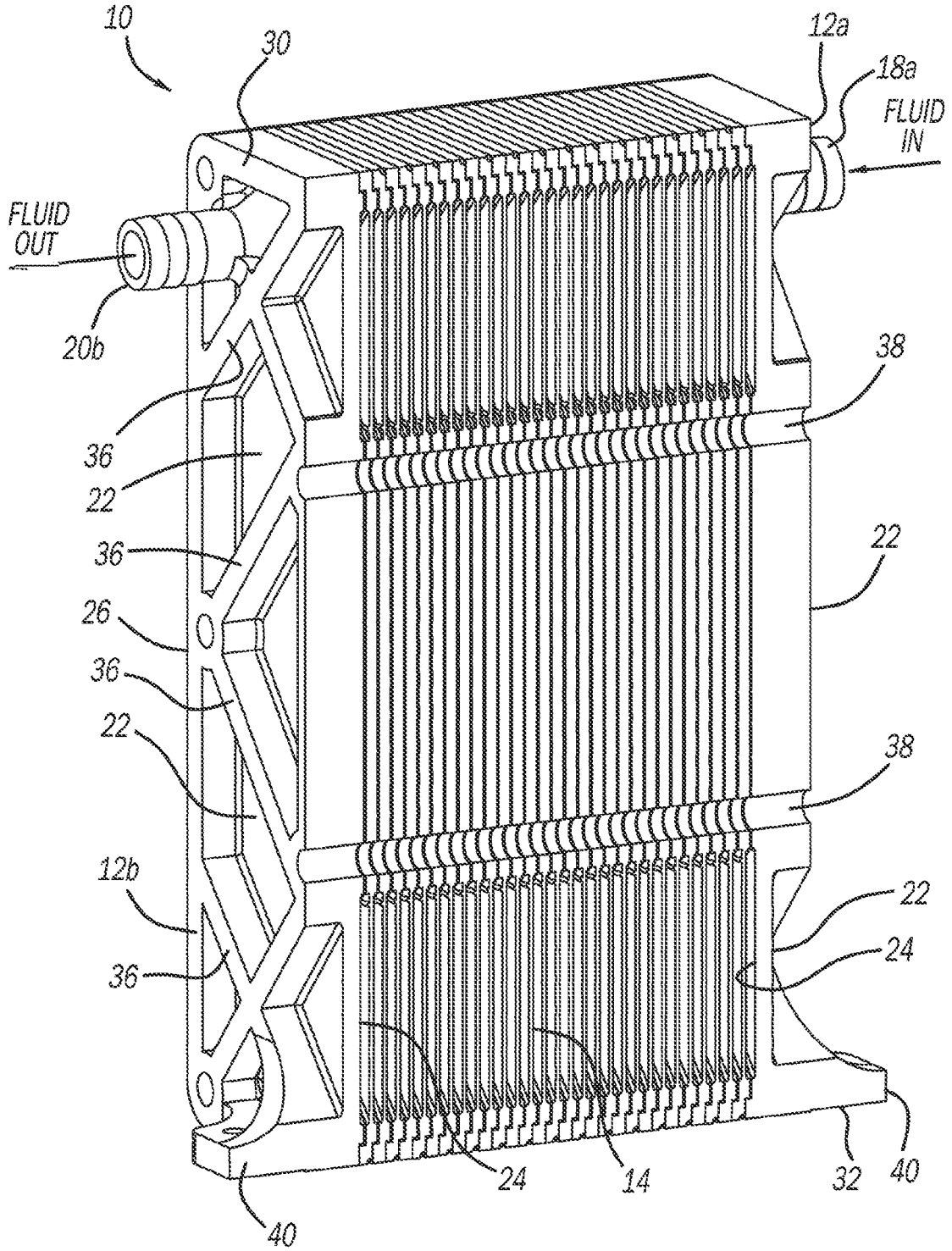
FIG. 2 is a cross-sectional view of the first example heat exchanger illustrated in FIG. 1.

End plates 12*a* and 12*b* also include a plurality of apertures 38 that are each configured for receipt of a fastener (not shown) that extends through the entire width W of the heat exchanger 10 (i.e., from end plate 12*a* to the opposite end plate 12*b* as best shown in FIG. 1), and an outwardly extending flange 40 having through-holes 42 for rigidly attaching heat exchanger 10 to a surface (not shown) that can be used to support heat exchanger 10.

As best shown in FIG. 5, second major surface 24 of end plate 12*a* defines a flow trough 34 that, in the illustrated embodiment, communicates with fluid inlet 18*a*. In a counter-flow configuration where each end plate 12*a*, 12*b* includes a single fluid inlet 18*a*, 18*b* and a single fluid outlet 20*a*, 20*b*, respectively, the flow trough 34 of end plate 12*a* communicates with fluid inlet 18*a*, and the opposite end plate 12*b* has a flow trough 34 that communicates with fluid outlet 20*b*. Thus, in the counter-flow configuration, heat exchanger 10 includes two fluid flow paths—one that extends from fluid inlet 18*a* of end plate 12*a* to fluid outlet 20*b* of end plate 12*b*, and one that extends from fluid inlet 18*b* of end plate 12*b* to fluid outlet 20*a* of end plate 12*a*.

The flow trough 34 of end plate 12*a* illustrated in FIG. 5 includes a pair of flow channels 44*a* and 44*b* that are separated by a dividing wall 46. Although only a single dividing wall 46 is illustrated, it should be understood that multiple dividing walls 46 can be used to ensure proper support of heat transfer films 16, as will be described in more detail later. As fluid enters from fluid inlet 18*a*, the fluid may enter either of the flow channels 44*a* and 44*b* and flow toward fourth minor side surface 32. As the fluid flows through either of the flow channels 44*a* and 44*b*, the fluid will first pass through a plurality of nubs 47 formed in each flow channel 44*a*, 44*b*. Nubs 47 are designed to increase structural rigidity of end plate 12*a*, as well as provide support for fluid transfer film 16.

After passing through nubs 47, the fluid will encounter a textured or turbulence inducing surface 48 that increases the turbulence of the fluid, which enhances heat exchange of the fluid with the heat transfer film 16 positioned between the second major surface 24 of end plate 12*a* and the adjacent flow plate 14 to the fluid flowing in the opposite direction on the other side of the heat transfer film 16, or vice versa. In other words, the flow of fluid along flow channels 44*a* and 44*b* transitions from a laminar flow to a turbulent flow when the fluid encounters turbulence inducing surface 48.

Turbulence inducing surface 48 includes a plurality of elongated ribs or bumps 50 that extend in a direction from first major side surface 26 toward second major side surface 28 across end plate 12*a*. While bumps 50 are each illustrated as being elongated, a series of bumps 50 that appear to form a dotted line may be used instead, if desired. In addition, it should be understood that any type of dimensional feature having a variable size, shape, and quantity can be used in place of bumps 50 so long as the dimensional feature provides for a turbulent flow of the fluid while flowing along turbulence inducing surface 48, and assists in controlling the amount of heat transfer, pressure loss of the fluid, and the effectiveness of the heat exchanger 10.

Dividing wall 46 includes a first section 52 located proximate fluid inlet 18*a* that transitions to second section 54 that travels along a center of end plate 12*a*, which transitions to a third section 56 that is located proximate an inlet port 58*a* or 58*b* formed in the adjacent flow plate 14 (FIG. 6). Third section 56 may be contoured at 60 to assist in increasing turbulence of the fluid flow through flow trough 34. In addition to dividing flow trough 34 into a pair of flow channels 44*a* and 44*b*, dividing wall 46 also provides additional structural rigidity to end plate 12*a* to withstand fluid pressures and pressure fluctuations that may occur during the heat exchange process. In addition, it should be noted that dividing wall 46 includes apertures 38 that are configured for receipt of the fasteners (not illustrated) that extend through heat exchanger 10. Thus, dividing wall 46 also provides increased structural rigidity to heat exchanger 10 to withstand tightening of the fasteners (not illustrated) to an extent that heat exchanger 10 will remain hermetically sealed throughout use of heat exchanger 10.

Heat transfer films 16 (FIGS. 3 and 4) are polymer films that are formed of a corrosion-resistant material such as polyether ether ketone (PEEK), polyethylene, acrylonitrile butadiene styrene (ABS), polyvinyl chloride (PVC), or some other type of polymer material that is corrosion-resistant and satisfactory for heat exchange. Heat transfer films 16 are shaped to correspond to a recess 62 formed in second major surface 24 of end plate 12*a* such that an entirety of flow trough 34 is covered by the heat transfer film 16.

Although not required, heat transfer film 16 may include a gasket 17 integral with the heat transfer film 16 and/or the heat transfer film 16 may have a removable adhesive layer 19 that maintains its adhesive quality when removed from the heat transfer film 16. Alternatively, gasket 17 may be in the form of a resilient sealant that is applied to the heat transfer film 16, the heat transfer film 16 may be shaped such that a perimeter of the heat transfer film is configured to be interference fit with an adjacent end plate or flow plate, or the heat transfer film 16 can be joined to an end plate or flow plate through application of heat.

Heat transfer film 16 includes openings 64 that permits fluid to pass from flow trough 34 to one of the inlet ports 58*a* or 58*b* of the adjacent flow plate 14. While heat transfer film 16 may also include holes 66 that correspond to apertures 38 to permit the fasteners (not shown) that bind heat exchanger 10 together to pass through heat transfer film 16, it should be understood that holes 66 are optional to an extent that the fasteners (not shown) may simply pierce the polymer material of the heat transfer film 16 when inserted through the heat exchanger 10. A thickness of the heat transfer films 16 is variable dependent on the application in which heat exchanger 10 is being used. In the illustrated embodiment, however, a thickness of the heat transfer films 16 may be in the range of 0.0005 inches to 0.010 inches (0.0127 to 0.254 mm).

Now referring to FIGS. 3 and 6, the plurality of flow plates 14 will be described. The construction of each of the flow plates 14 is the same, albeit arranged alternately in opposite manners throughout the heat exchanger 10, which will be described in detail later. As best shown in FIG. 6, each flow plate 14 is shaped to correspond to the shape of end plate 12*a*. Flow plate 14 includes a first flow surface 68 formed on a first major side 70 and a second flow surface (not shown) formed on a second major side 72 of the flow plate 14. While the second flow surface is not illustrated in FIG. 6, it should be understood that the second flow surface is a mirror image of that illustrated in FIG. 6.

The flow surfaces 68 of flow plate 14 are similar to the flow troughs 34 of end plates 12*a* and 12*b*. In this regard, the flow surfaces 68 include a pair of flow channels 74*a* and 74*b* that are separated by a dividing wall 76. Although only a single dividing wall 76 is illustrated, it should be understood that multiple dividing walls 76 can be used to ensure proper support of heat transfer films 16, as will be described in more detail later. As fluid enters from one of the inlet ports 58*a* or 58*b*, the fluid may enter either or both of the flow channels 74*a* and 74*b* and flow away from the inlet port 58*a* or 58*b*. As the fluid flows through either of the flow channels 74*a* and 74*b*, the fluid will first pass through a plurality of nubs 77 formed in each flow channel 74*a*, 74*b*. Nubs 77 are designed to increase structural rigidity of flow plate 14, as well as provide support for fluid transfer film 16. After passing through nubs 77, the fluid will encounter a textured or turbulence inducing surface 78 that increases the turbulence of the fluid, which enhances heat exchange of the fluid with the heat transfer film 16 positioned between the second major surface 24 of end plate 12*a* and the adjacent flow plate 14 to the fluid flowing in the opposite direction on the other side of the heat transfer film 16, or vice versa. Turbulence inducing surface 78 includes a plurality of elongated ribs or bumps 80 that extend in a direction across flow plate 12. While bumps 80 are each illustrated as being elongated, a series of bumps 80 that appear to form a dotted line may be used instead, if desired.

Dividing wall 76 includes a first section 82 located proximate inlet port 58*a* or 58*b* that transitions to second section 84 that travels along a center of flow plate 14, which transitions to a third section 86 that is located proximate an inlet port 58*a* or 58*b* formed in the adjacent flow plate 14 (FIG. 3). Third section 86 may be contoured at 90 to assist in increasing turbulence of the fluid flow through flow surface 68. In addition to dividing flow surface 68 into a pair of flow channels 74*a* and 74*b*, dividing wall 76 also provides additional structural rigidity to flow plate 14 to withstand fluid pressures and pressure fluctuations that may occur during the heat exchange process. In addition, it should be noted that dividing wall 76 includes apertures 38 that are configured for receipt of the fasteners (not illustrated) that extend through heat exchanger 10. Thus, dividing wall 76 also provides increased structural rigidity to heat exchanger 10 to withstand tightening of the fasteners (not illustrated) to an extent that heat exchanger 10 will remain hermetically sealed throughout use of heat exchanger 10.

It should be understood that the shape of end plates 12*a*, 12*b* and flow plates 14 support the heat transfer films 16 such that a minimum area of the heat transfer film is unsupported by features of the end plates 12*a*, 12*b* and flow plates 14 such as the recess 62 of the end plates 12*a*, 12*b*, the dividing wall 46 and nubs 47 of the end plates 12, 12*b*, and the dividing wall 76 and nubs 77 of the flow plates 14. Supporting the heat transfer films 16 in this manner assists in preventing the heat transfer films 16 from losing its form or leaking. Preferably, the distance of an unsupported area of the heat transfer film ranges between 0.25 inches to 3 inches. Thus, in larger heat exchangers 10, it may be useful to include multiple dividing walls 46 and 76 to ensure that the unsupported area of the heat transfer film 16 ranges between 0.25 inches to 3 inches. Moreover, it should be understood that end plates 12*a*, 12*b* and flow plates 14 can be formed by an injection or compression molding method, by 3D printing, or some other type of manufacturing method. Any of these methods enable end plates 12*a*, 12*b* and flow plates 14 to have each of the above-described support features in any manner or configuration desired, and permits the flow troughs 34 and flow surfaces 68 to have the textured or turbulence inducing surface in any configuration desired which enables designs that can be tailored to a specific application.

Now flow of a fluid through the heat exchanger 10 will be described. Specifically, the counter-flow of fluid through the heat exchanger 10 will be described. As best shown in FIG. 3, a first fluid (e.g., a warm fluid) enters heat exchanger 10 through fluid inlet 18*a* of end plate 12*a* and travels through flow trough 34 toward the inlet port 58*a* of the flow plate 14*a* arranged adjacent end plate 12*a* (i.e., in a downward direction in FIG. 3). While in flow trough 34 of end plate 12*a*, the first fluid will exchange heat with heat transfer film 16. As the first fluid travels from flow trough 34 of end plate 12*a* toward the inlet port 58*a* of the flow plate 14*a*, the first fluid will flow from flow trough 34 of end plate 12*a* through opening 64 in heat transfer film 16, and then through inlet port 58*a* of the adjacent flow plate 14*a*. The first fluid will then flow in the opposite direction along flow surface 68 of the adjacent flow plate 14*a* (i.e., in an upward direction in FIG. 3), which is not visible in FIG. 3, toward an inlet port 58*a* of an adjacent flow plate 14*b*, at which time the first fluid will pass through the opening 64 in the heat transfer film 16 between the flow plates 14*a* and 14*b*, through the fluid inlet port 58*a* of the flow plate 14*b*, and then along the flow surface 68 of the flow plate 14*b* (i.e., in a downward direction in FIG. 3). During flow along flow surface 68 of flow plate 14*b* that is not visible in FIG. 3, the first fluid will exchange heat with heat transfer film 16 between flow plate 14*b* and adjacent flow plate 14*c* before entering the opening 64 in the heat transfer film and then through inlet port 58*a* of the flow plate 14*c*. This back and forth flow through the heat exchanger 10 will continue until the first fluid exits the outlet port 20*b* of end plate 12*b*.

Similarly, as a second fluid (e.g., a cool fluid) enters the fluid inlet 18*b* of end plate 12*b* it will travel down along flow trough 34 of end plate 12*b* toward the inlet port 58*b* of a flow plate 14*d*, pass through the opening 64 in the heat transfer film 16 between the end plate 12*b* and the flow plate 14*d*, enter the inlet port 58*b* of the flow plate 14*d*, and then travel upward along the flow surface 68 of flow plate 14*d* toward the inlet port 58*b* of the flow plate 14*e*, where the process continues such that the second fluid will travel back and forth through the heat exchanger 10 until the second fluid reaches the fluid outlet 20*a* of end plate 20*a*. This is possible because each side of each flow plate 14 includes a flow surface 68. In this manner, as the first and second fluids each travel over each side of the flow plates 14, heat is exchanged between the two fluids on either side of the flow plates 14 through the heat transfer films 16 located between adjacent flow plates 14. That is, the first fluid that enters fluid inlet 18*a* of end plate 12*a* will exchange heat with the second fluid that enters fluid inlet 18*b* of end plate 12*b* as the two fluids flow past each other while being separated by the heat transfer films 16.

The above-described counter-flow of fluids through the heat exchanger 10 will now be contrasted with a parallel-flow of fluids through the heat exchanger 10. In a parallel-flow heat exchanger 10, the fluid outlet 20*a* of end plate 12*a* will function as a second fluid inlet 18*a*, and the fluid inlet 18*b* of end plate 12*b* will function as a second fluid outlet 20*b*. In other words, two fluids will simultaneously enter the two fluid inlets formed on end plate 12*a* before subsequently simultaneously exiting the heat exchanger 10 through the two fluid outlets formed on end plate 12*b*. In such a configuration, instead of the two fluids flowing in opposite directions while separated by the heat transfer films 16 like in the counter-flow configuration, the two fluids will each flow in the same direction while being separated by the heat transfer films 16. In either case, heat is exchanged between the two fluids.

As a first fluid (e.g., a warm fluid) enters fluid inlet 18*a*, the first fluid will enter the flow trough 34 of end plate 12*a* and flow towards the lower opening 64 of heat transfer film 16 located between the end plate 12*a* and flow plate 14*a*. The first fluid will then flow through the lower opening 64 and fluid inlet port 58*a* of flow plate 14*a* before entering the flow surface 68 of flow plate 14*a* located on the side of flow plate 14*a* that is not visible in FIG. 3. Then, the first fluid will flow upward along flow surface 68 of flow plate 14*a* before passing through the upper opening 64 of the heat transfer film 16 located between flow plate 14*a* and 14*b*, passing through fluid inlet port 58 of flow plate 14*b*, and entering the flow surface 68 of flow plate 14*b* located on the side of flow plate 14*b* that is not visible in FIG. 3. The first fluid will continue in this fashion until exiting fluid outlet 20*b* of end plate 12*b*.

Similarly, a second fluid (e.g., a cool fluid) that enters the second fluid inlet 20*a* of end plate 12*a* will immediately pass through the upper opening 64 of heat transfer film 16 between end plate 12*a* and flow plate 14*a* before entering the flow surface 68 on flow plate 14*a* that is visible in FIG. 3. The second fluid will flow down the visible flow surface 68 of flow plate 14*a* as the first fluid is flowing in the same direction down the flow trough 34 of end plate 12*a*, while being separated by the heat transfer film 16 between end plate 12*a* and flow plate 14*a*. Because the first fluid is warm and the second fluid is cool, or vice versa, the two fluids exchange heat with each other via the heat transfer film 16. The two fluids continue to flow back and forth in parallel until each fluid simultaneously exits the heat exchanger 10 through the two fluid outlets formed on end plate 12*b*.

Figure 7:
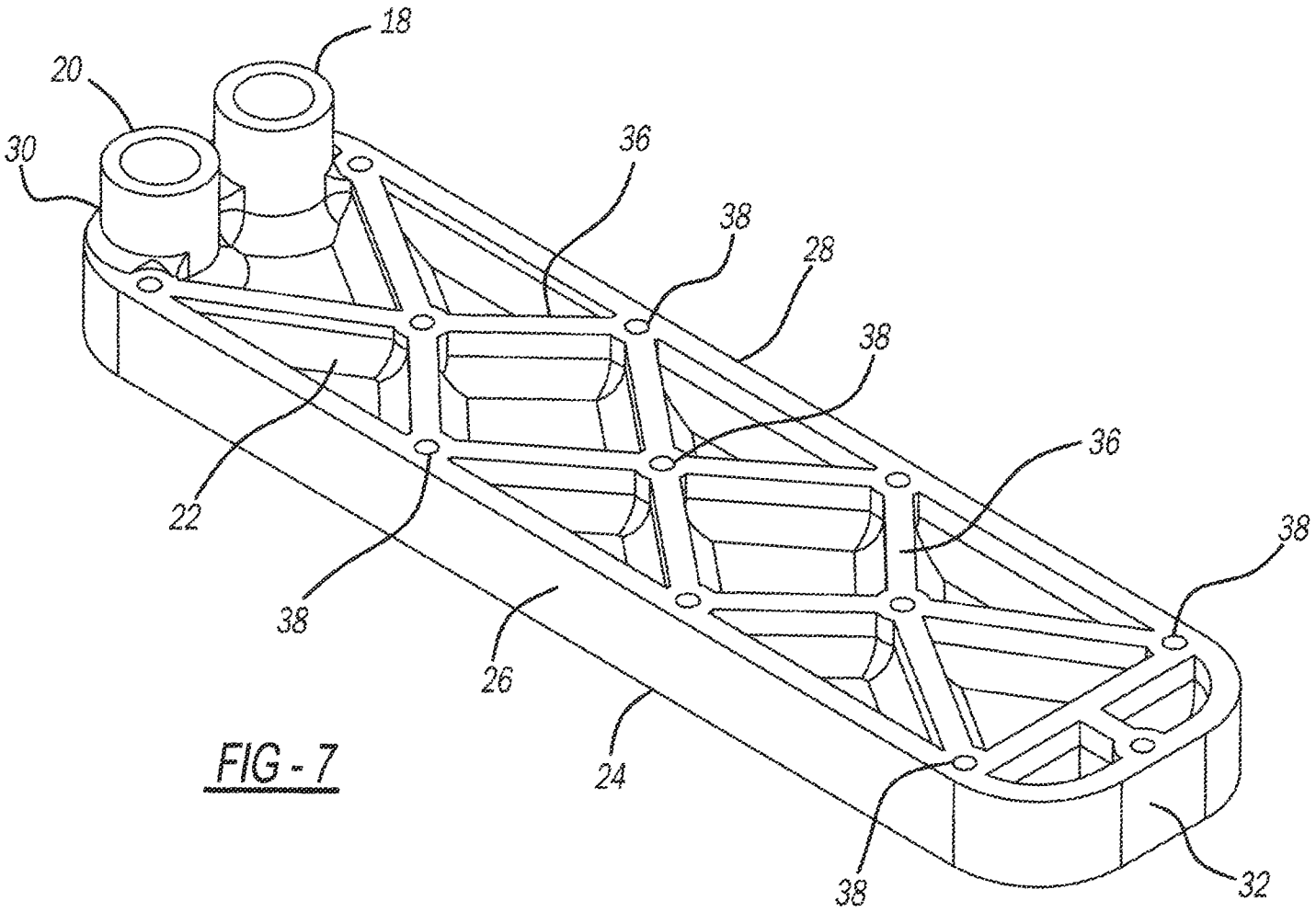
FIG. 7 is a perspective view of an end plate used in a second example heat exchanger according to a principle of the present disclosure.
Figure 8:
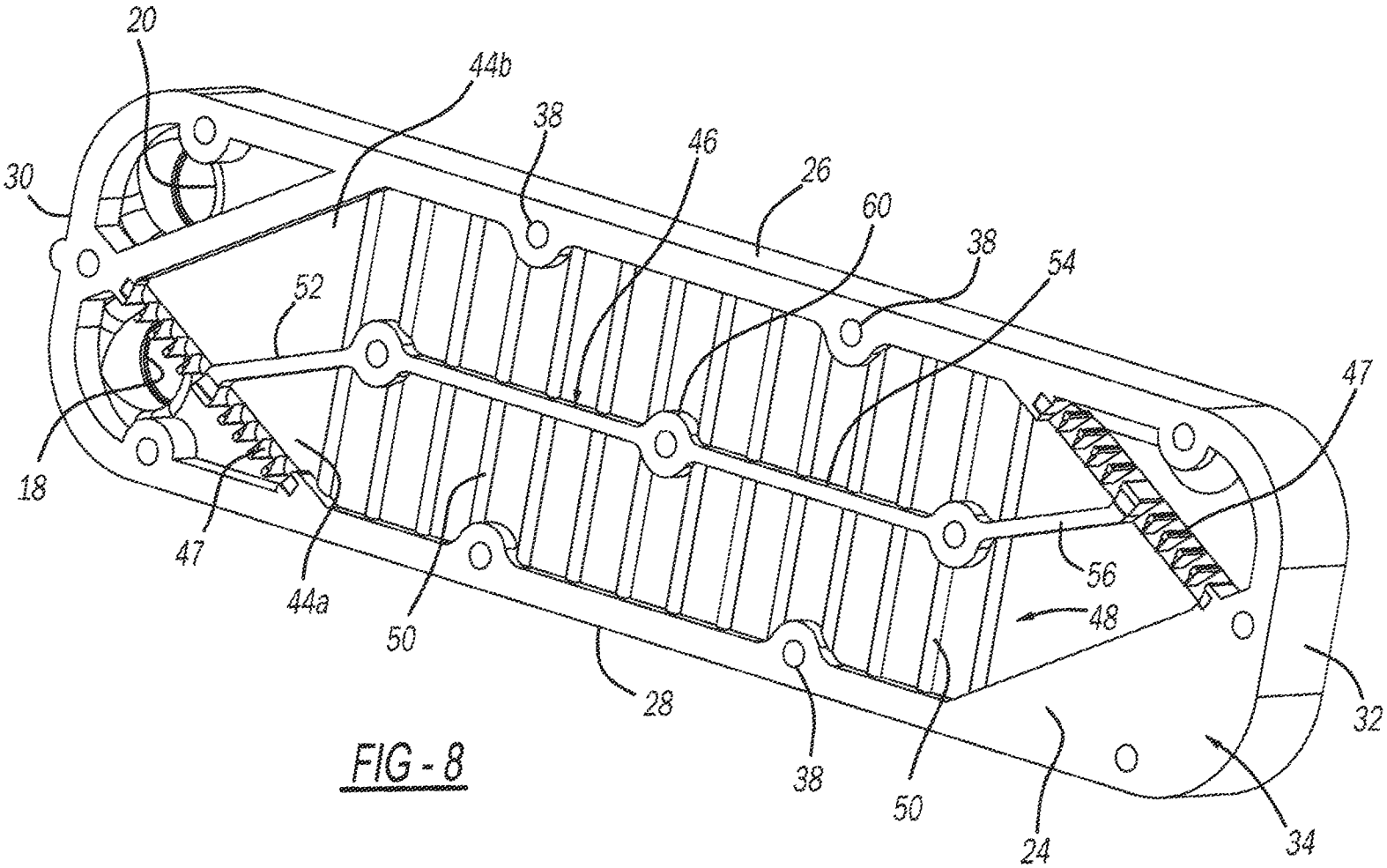
FIG. 8 is a perspective view of a flow-surface side of the end plate illustrated in FIG. 7.
Figure 9:
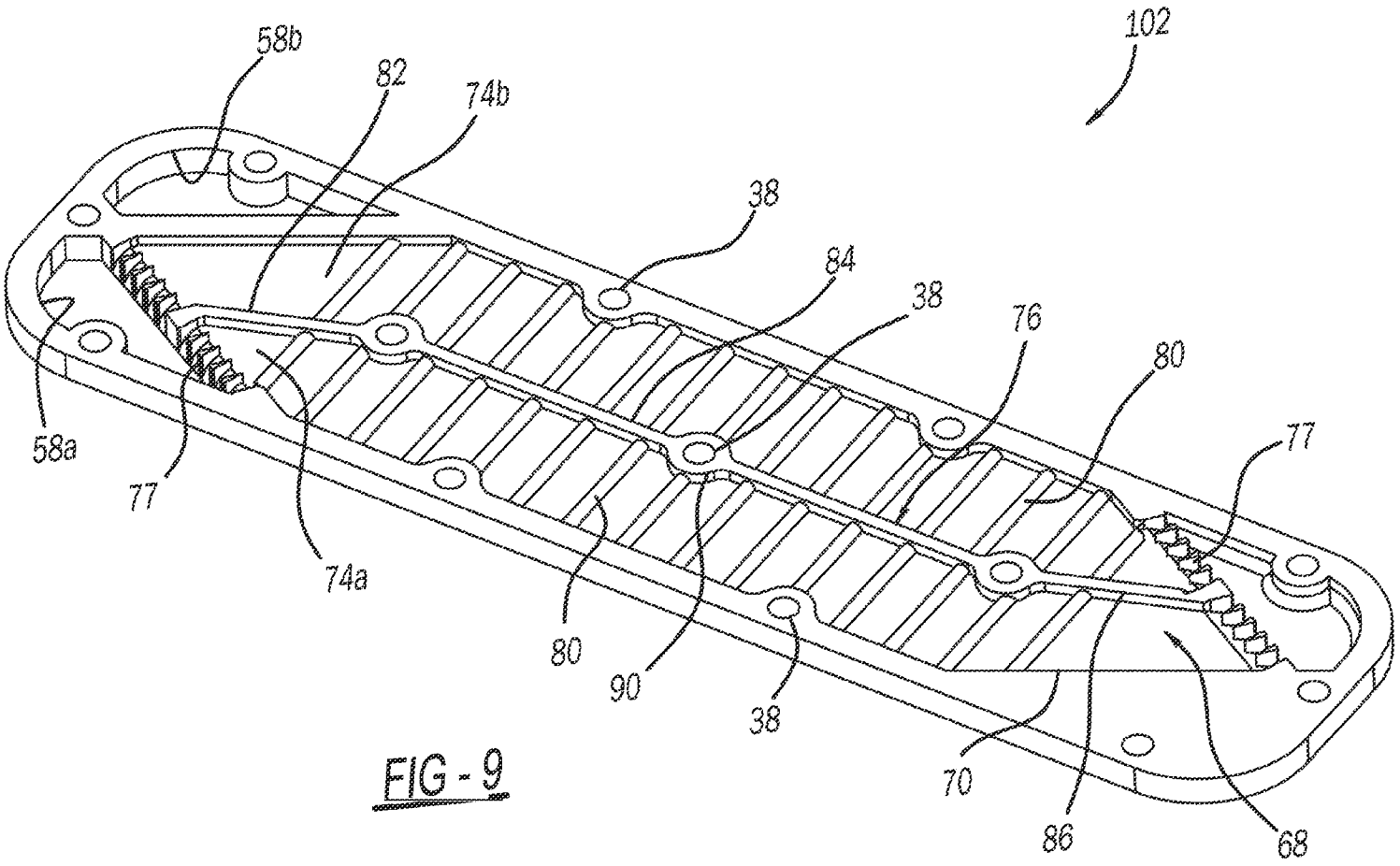
FIG. 9 is a perspective view of a flow plate used in conjunction with the end plate illustrated in FIGS. 7 and 8 to form the second example heat exchanger.

Now referring to FIGS. 7-9, end plates 100 and flow plates 102 that may be used in a second example heat exchanger will be described. While only a single end plate 100 is illustrated in FIGS. 7 and 8, and only a single flow plate 102 is illustrated in FIG. 9, it should be understood that a heat exchanger (not illustrated) including these components will include a pair of end plates 100 that sandwich a plurality of the flow plates 102. In addition, similar to heat exchanger 10, it should be understood that heat transfer films 16 will be located between the end plates 100 and an adjacent flow plate 102, and between adjacent flow plates 102.

The primary difference between a heat exchanger including end plates 100 and flow plates 102 is that the dimensions of a heat exchanger including these components will be less than the dimensions of the heat exchanger 10, which enables use in a system that uses less fluid volume in comparison to a larger fluid volume system. Thus, features that are common to end plates 100 and end plates 12*a* and 12*b*, and features that are common to flow plates 102 and flow plates 14, use the same reference numbers and description thereof will be omitted. Regardless, it should be understood that a heat exchanger that uses end plates 100 and flow plates 102 functions in the same manner as the heat exchanger 10 described above.

Figure 10:
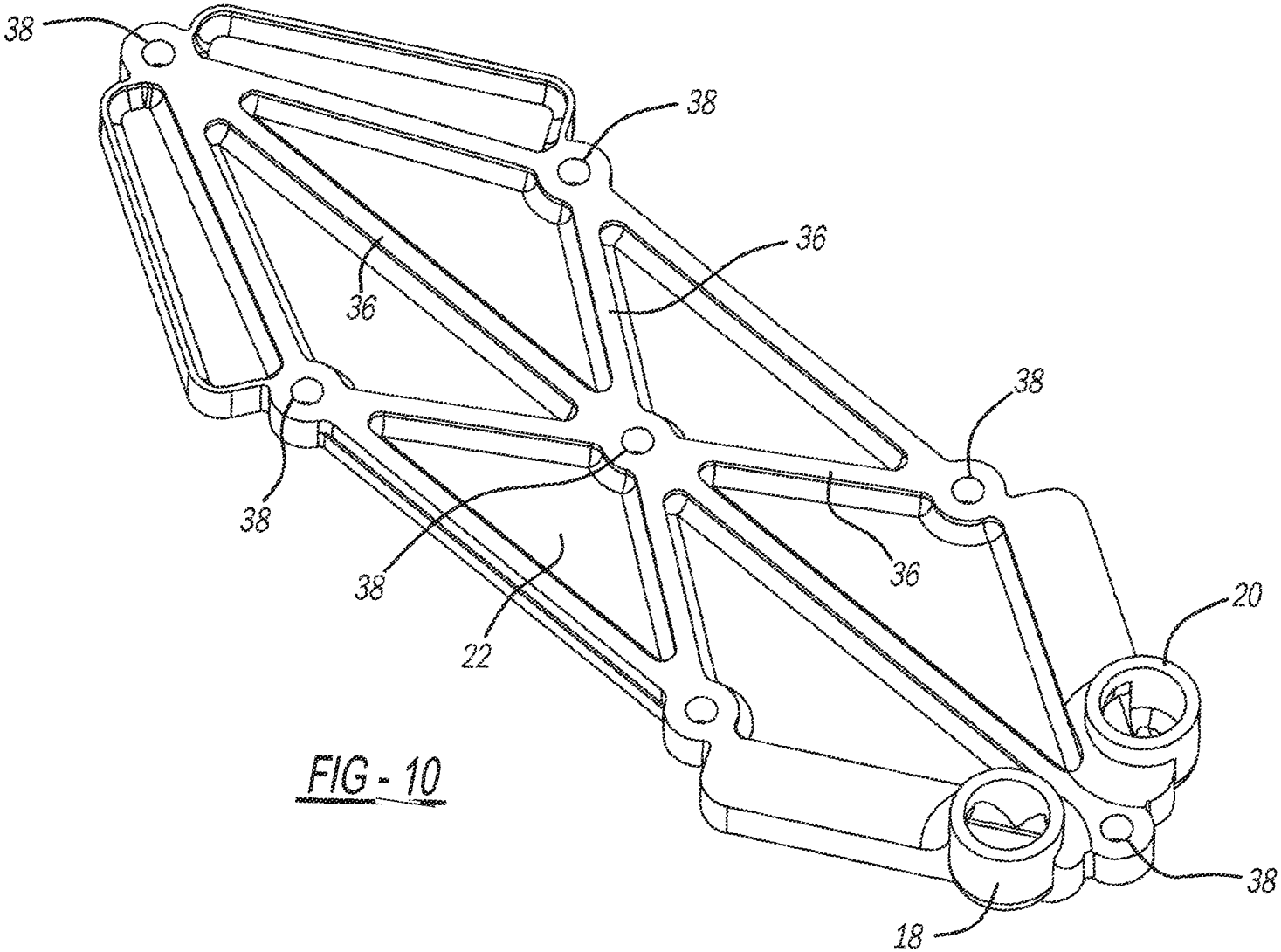
FIG. 10 is a perspective view of an end plate used in a third example heat exchanger according to a principle of the present disclosure.
Figure 11:
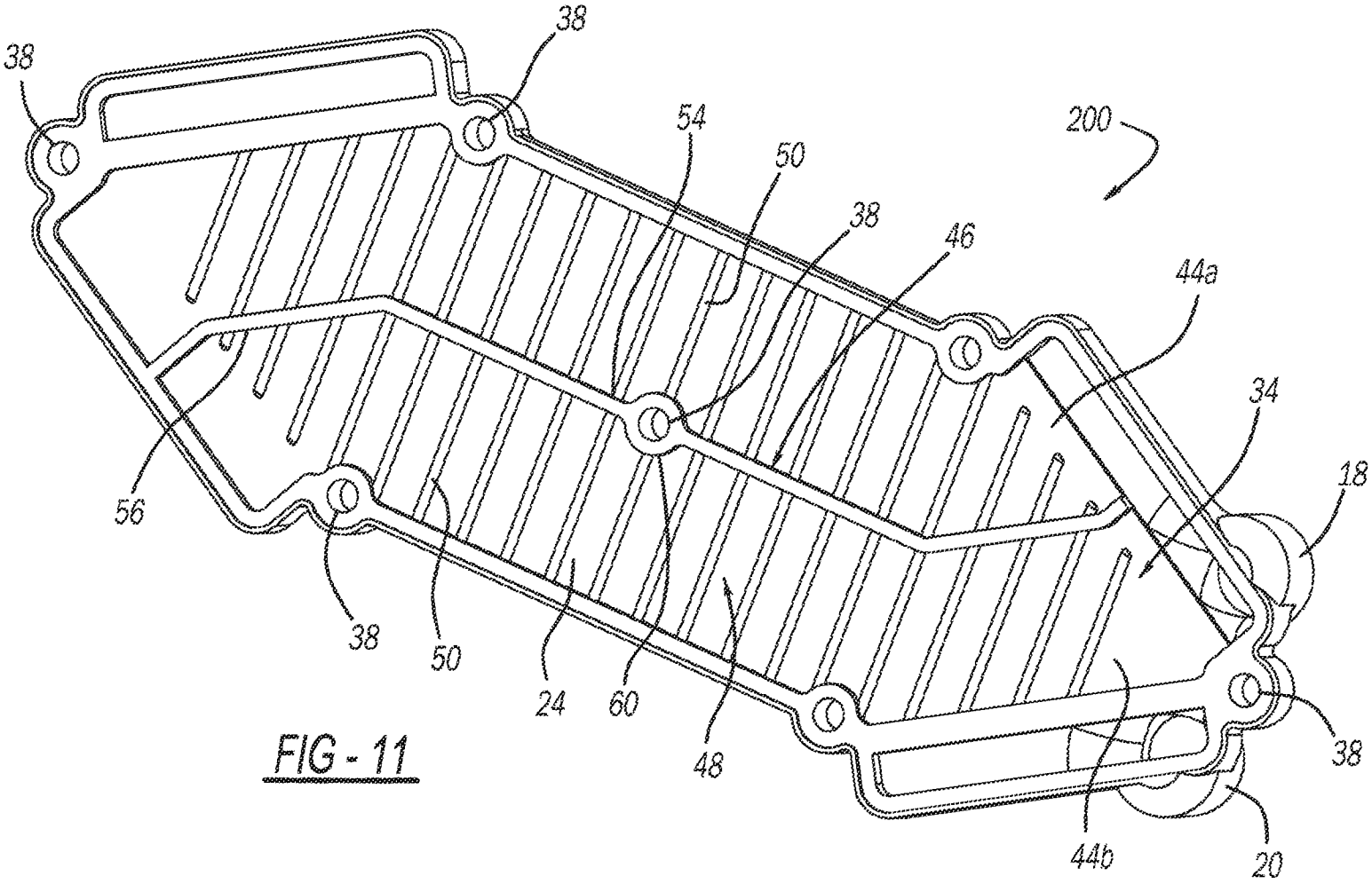
FIG. 11 is a perspective view of a flow-surface side of the end plate illustrated in FIG. 10.
Figure 12:
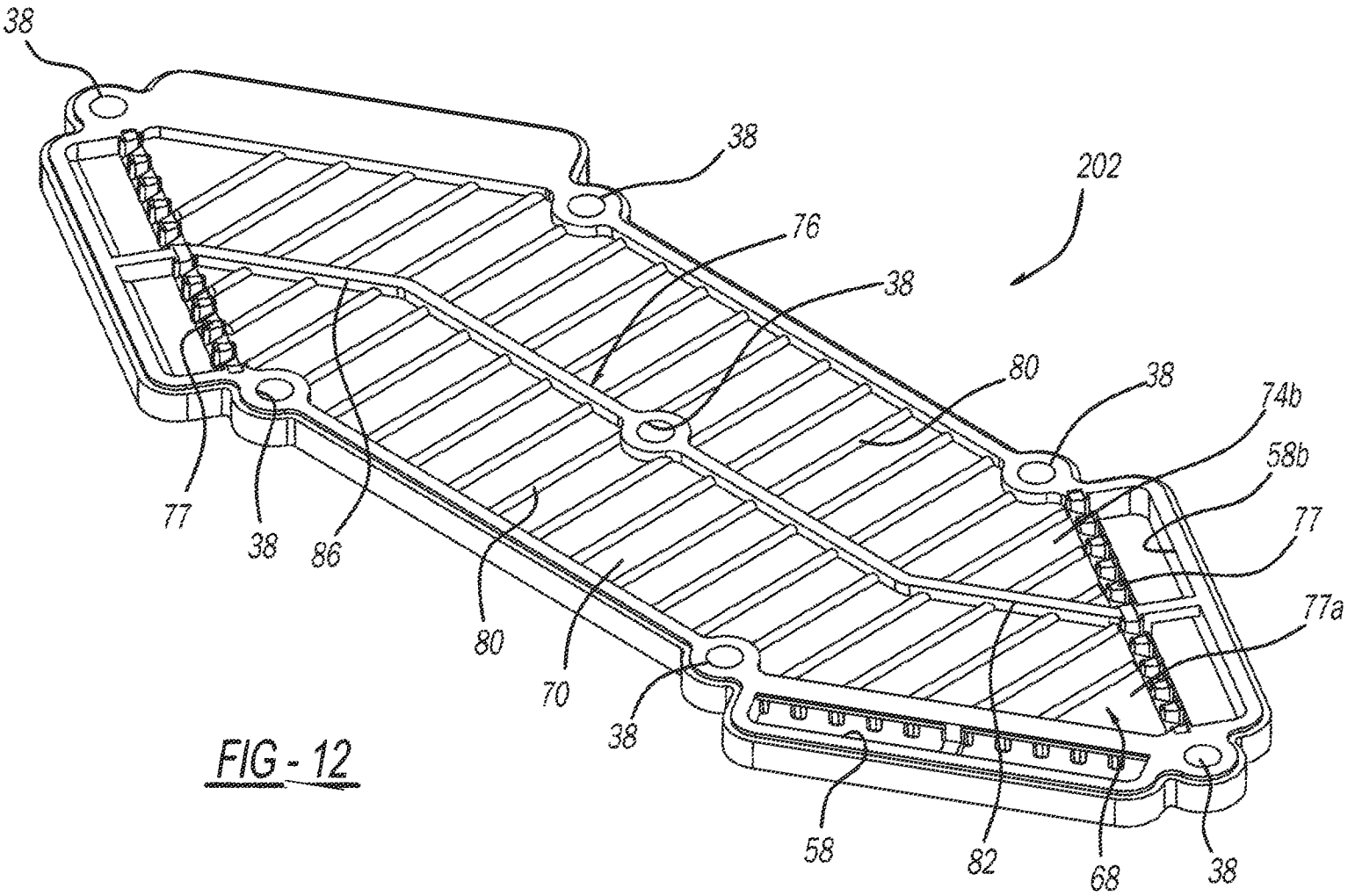
FIG. 12 is a perspective view of a flow plate used in conjunction with the end plate illustrated in FIGS. 10 and 11 to form the third example heat exchanger.

Now referring to FIGS. 10-12, end plates 200 and flow plates 202 that may be used in a third example heat exchanger will be described. While only a single end plate 200 is illustrated in FIGS. 10 and 11, and only a single flow plate 202 is illustrated in FIG. 12, it should be understood that a heat exchanger (not illustrated) including these components will include a pair of end plates 100 and that sandwich a plurality of the flow plates 102. In addition, similar to heat exchanger 10, it should be understood that heat transfer films 16 will be located between the end plates 200 and an adjacent flow plate 202, and between adjacent flow plates 202.

The primary difference between a heat exchanger including end plates 200 and flow plates 202 is that a shape a heat exchanger including these components is different from the shape of the components used in the heat exchanger 10 and the heat exchanger (not illustrated) that uses end plates 100 and flow plates 102. In this regard, the shape of end plates 200 and flow plates 202 is hexagonal rather than rectangular, which enables use in a system that has different packaging requirements. While the shape of a heat exchanger using end plates 200 and flow plates 202 may be different to account for packaging restraints, it should be understood that an overall size of such a heat exchanger may have a greater or lesser fluid volume in comparison to the previously described heat exchangers. Thus, features that are common to end plates 200 and end plates 12*a* and 12*b*, and features that are common to flow plates 202 and flow plates 14, use the same reference numbers and description thereof will be omitted. Regardless, it should be understood that a heat exchanger that uses end plates 200 and flow plates 202 functions in the same manner as the heat exchanger 10 described above.

Figure 13:
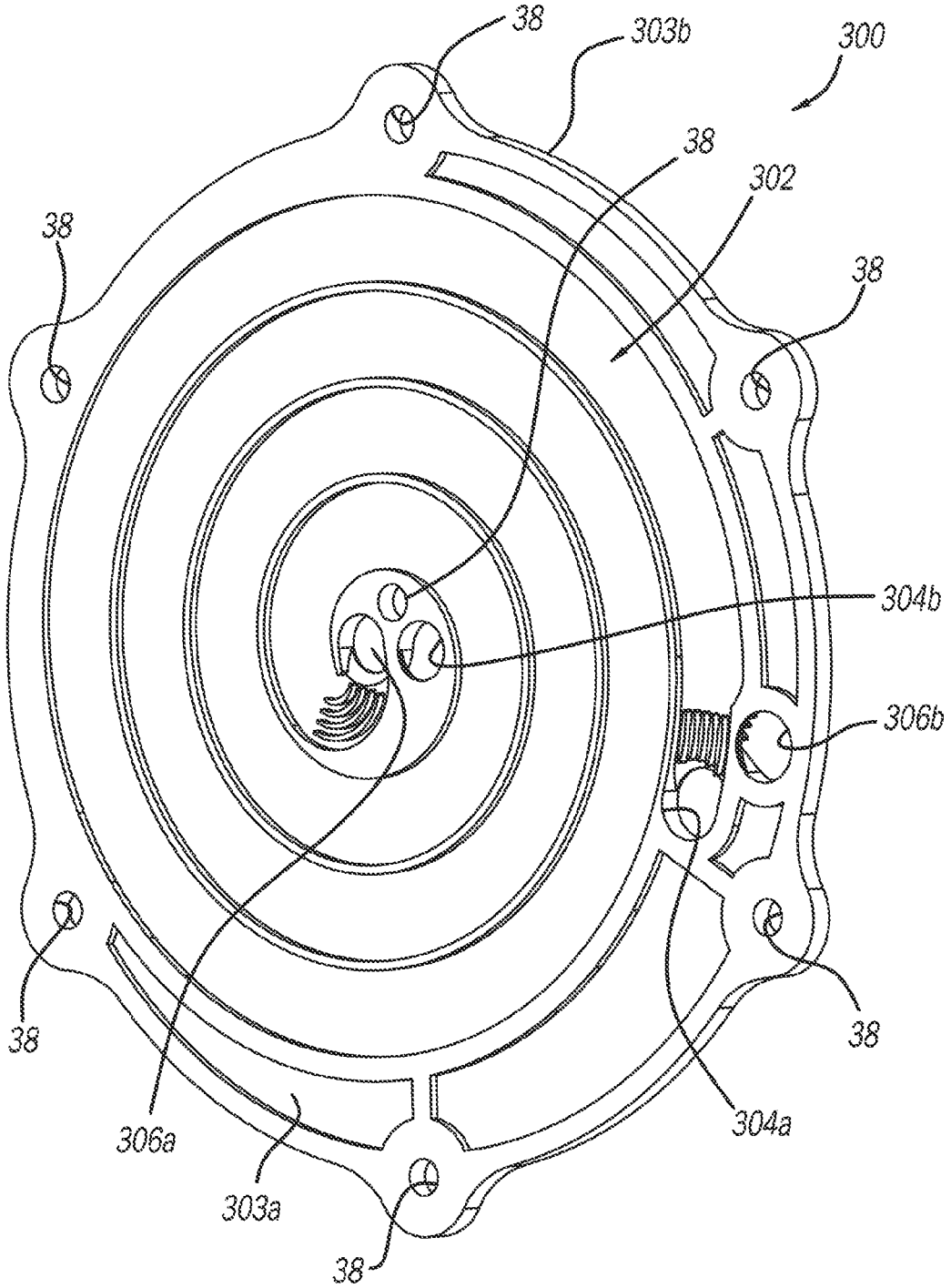
FIG. 13 is a perspective view of a flow plate that that may be used in a fourth example heat exchanger according to a principle of the present disclosure.

Now referring to FIG. 13, another flow plate 300 for use in a fourth example heat exchanger (not illustrated) will be described. While only a single flow plate 300 is illustrated in FIG. 13, it should be understood that a heat exchanger (not illustrated) including this components will include a pair of end plates (not shown) that sandwich a plurality of the flow plates 300. In addition, similar to heat exchanger 10, it should be understood that heat transfer films 16 will be located between adjacent flow plates 300, and between an end plate (not illustrated) and an adjacent flow plate 300.

The primary difference between a heat exchanger including flow plates 300 is that a flow channel 302 that is formed on each opposing major surface 303*a* and 303*b* of the flow plate 300 scroll-shaped, which enables the flow channel 302 to have a sufficient length to enable heat exchange from the fluid flowing through the flow channel 302 while minimizing the overall size of a heat exchanger (not illustrated) that includes the flow plate 300. Flow plate 300 includes a first inlet port 304*a* that may communicate with a fluid inlet (not shown) of an end plate (not shown). The scroll-shaped flow channel 302 travels from inlet port 304*a* to an outlet port 306*a*. Flow plate 300 also includes a second inlet port 304*b* that receives fluid from the outlet port 306*a* of an adjacent flow plate 300, which then travels through the flow channel 302 to a second outlet port 306*b* that communicates with either a fluid outlet of an adjacent end plate (not shown) or with a fluid inlet 304*a* of an oppositely adjacent flow plate 300. Thus, one fluid may flow in one direction on one side 303*a* of the plate (e.g., from inlet port 304*a* to outlet port 306*a*), while another fluid may flow in the opposite direction (e.g., from inlet port 304*b* to outlet port 306*b*) on the other side 303*b* of the flow plate 300.

In each of the above-described example embodiments, it should be understood that the "fluid" that flows in opposite direction on opposing sides of the flow plates can be the same fluid. That is, the heat exchanger may be part of a circuit that includes a single fluid. During use of the heat exchanger in the selected system, the fluid may require heat transfer. Thus, the fluid that requires heat transfer may be "warm" as it enters the heat exchanger where it is subsequently "cooled," and after the cooled fluid exits the heat exchanger it can travel through the circuit for use elsewhere (if necessary) before reentering the heat exchanger and exchanging heat with the "warm" fluid that is entering the heat exchanger.

Alternatively, the heat exchanger can be used to conduct heat transfer between two separate fluids. Such a case may arise when a single heat exchanger (or a plurality of heat exchangers arranged in series) is used between two separate circuits that each use a separate fluid. In such a case, a first fluid may enter the heat exchanger while a second fluid also enters the heat exchanger. As the first and second fluids flow past or in parallel with each other on opposing sides of the heat transfer film 16 between adjacent flow plates 14, heat exchange can be conducted between the two different fluids. The fluids will not mix with each other due to the intervening heat transfer film 16.

Lastly, it should be understood that the end plates (e.g., 12*a*, 12*b*) and flow plates (e.g., 14) of each of the above-described example embodiments may have any three-dimensional shape so long as the end plates and flow plates can support a heat transfer film 16 between two or more flow paths. In this regard, while heat exchangers are illustrated having rectangular plates (e.g., FIGS. 1-9), hexagonal (e.g., FIGS. 10-12), or round (e.g., FIG. 13), other three-dimensional plates are contemplated (e.g., oval, square, triangular, and other). In this regard, because the end plates and flow plates may be formed using various processes including injection or compression molding and 3D printing, the shapes, sizes, and features of the end plates and flow plates can be tailored to the specific application in which the heat exchanger is to be used.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A heat exchanger, comprising:

a pair of end plates, each of the end plates including a first major surface and an opposite second major surface, the first major surfaces each including a fluid inlet and a fluid outlet and the opposite second major surfaces each including a flow trough, the fluid inlet of each end plate being in communication with the flow trough formed on the opposite second major surface of the respective end plate;

a plurality of flow plates sandwiched between the pair of end plates, each of the flow plates having a first side and an opposite second side, and each of the first side and the opposite second side including a flow surface, the flow surfaces of each flow plate being configured to communicate with either the flow trough of an adjacent end plate or one of the flow surfaces of an adjacent flow plate; and a plurality of heat transfer films that are respectively positioned between adjacent flow plates, and between each of the end plates and a flow plate immediately adjacent to each of the end plates, each of the heat transfer films being a polymer film having a thickness that is less than a thickness of each of the end plates and flow plates, wherein the flow troughs and the flow surfaces each include a first flow channel and a second flow channel that each include a turbulence inducing surface including a plurality of ribs or bumps that are configured to increase a turbulence of a fluid flowing in the flow troughs and flow surfaces; and wherein the first flow channel and second flow channel are separated by a dividing wall having a height that is greater than a height of the plurality of ribs or bumps, the dividing wall supporting the heat transfer film in a manner that a minimum area of the heat transfer film is unsupported.

2. The heat exchanger according to claim 1, wherein the flow troughs and flow surfaces communicate with each other such that a fluid that enters the fluid inlet of one of the end plates will exit the fluid outlet of the other end plate, and a fluid that enters the fluid inlet of the other end plate will exit the fluid outlet of the one end plate.

3. The heat exchanger according to claim 2, wherein the fluid that enters the fluid inlet of the one end plate will enter the flow trough on the opposite second major surface of the one end plate and flow in a first direction before entering the flow surface of the adjacent flow plate and flowing in a second and opposite direction.

4. The heat exchanger according to claim 1, wherein the pair of end plates and each of the flow plates are formed of a polymeric material that is impermeable and resistant to corrosion.

5. The heat exchanger according to claim 1, wherein the heat transfer films include one of a removable adhesive layer, an integral gasket, and a resilient sealant to sealingly engage with the end plates and the flow plates, the heat transfer films are sealingly engaged with the end plates and the flow plates by being interference fit thereto, or the heat transfer films are joined to the end plates and flow plates through application of heat.

6. The heat exchanger according to claim 1, wherein the flow troughs and flow surface each include a plurality of support features that include a plurality of nubs that are spaced part to permit fluid flow therebetween, the plurality of support features in combination with the dividing wall supporting the heat transfer film in a manner that the minimum area of the heat transfer film is unsupported.

7. The heat exchanger according to claim 1, wherein the first major surface of each of the end plates includes a plurality of ribs that increase the rigidity of the end plates.

8. The heat exchanger according to claim 1, wherein plurality of ribs or bumps are elongated and extend across the first and second flow channels, respectively.

9. The heat exchanger according to claim 1, wherein each of the flow plates includes a fluid inlet port and a fluid outlet port, wherein the fluid inlet port of a respective flow plate communicates with either the flow trough of the adjacent end plate or the fluid outlet port of the adjacent flow plate.

10. The heat exchanger according to claim 1, wherein the flow troughs and flow surfaces are scroll-shaped.

11. A heat exchanger, comprising:

a first end plate and a second end plate, each of the end plates including a first major surface and an opposite second major surface, the first major surface of the first end plate including a pair of fluid inlets and the opposite second major surface including a first flow trough, the first major surface of the second end plate including a pair of fluid outlets and the opposite second major surface including a second flow trough, one of the fluid inlets of the first end plate being in communication with the first flow trough formed on the opposite second major surface of the first end plate and one of the fluid outlets of the second end plate being in communication with the second flow trough formed on the opposite second major surface of the second end plate;

a plurality of flow plates sandwiched between the first and second end plates, each of the flow plates having a first side and an opposite second side, and each of the first side and the opposite second side including a flow surface, the flow surfaces of each flow plate being configured to communicate with the first flow trough of the first end plate, the second flow trough of the second end plate, or one of the flow surfaces of an adjacent flow plate; and a plurality of heat transfer films that are respectively positioned between adjacent flow plates, and between each of the first and second end plates and a flow plate immediately adjacent to each of the first and second end plates, each of the heat transfer films being a polymer film having a thickness that is less than a thickness of each of the end plates and flow plates, wherein the fluid inlets of the first end plate are configured for receipt of a first fluid and a second fluid, respectively, such that the first and second fluids travel through the heat exchanger in parallel, and such that the first and second fluids exchange heat with each other via the heat transfer films, and wherein the first flow trough, the second flow trough, and the flow surfaces each include a first flow channel and a second flow channel that are separated by a dividing wall and include a turbulence inducing surface that includes a plurality of ribs or bumps that are configured to increase a turbulence of the first and second fluids flowing in the first and second flow channels, the first end plate, the second end plate, and each of the flow plates include a plurality of support features, and the dividing wall and the plurality of support features each have a height that is greater than a height of the plurality of ribs or bumps such that the dividing wall and the plurality of support features each support the heat transfer film in a manner that a minimum area of the heat transfer film is unsupported.

12. The heat exchanger according to claim 11, wherein the plurality of support features include a plurality of nubs that are spaced part to permit fluid flow therebetween.

13. The heat exchanger according to claim 11, wherein the plurality of ribs or bumps are elongated and extend across the first and second flow channels, respectively.

14. The heat exchanger according to claim 11, wherein the first fluid that enters one of the fluid inlets of the first end plate will enter the first flow trough on the opposite second major surface of the first end plate and flow in a first direction before entering one of the flow surfaces of the adjacent flow plate and flow in a second and opposite direction.

15. The heat exchanger according to claim 11, wherein the first and second end plates and each of the flow plates are formed of a polymeric material that is impermeable and resistant to corrosion.

16. The heat exchanger according to claim 11, wherein the heat transfer films include one of a removable adhesive layer, an integral gasket, and a resilient sealant to sealingly engage with the end plates and the flow plates, the heat transfer films are sealingly engaged with the end plates and the flow plates by being interference fit thereto, or the heat transfer films are joined to the end plates and flow plates through application of heat.

17. The heat exchanger according to claim 11, wherein the first major surface of each of the first and second end plates includes a plurality of ribs that increase the rigidity of the first and second end plates.

18. The heat exchanger according to claim 11, wherein the first flow trough, the second flow trough, and each of the flow surfaces are scroll-shaped.

* * * * *